US005227849A

United States Patent [19]

Katsumi et al.

[11] Patent Number: 5,227,849

[45] Date of Patent: Jul. 13, 1993

[54] DEVELOPING APPARATUS AND DEVELOPER CARRYING MEMBER USABLE THEREWITH

[75] Inventors: Toru Katsumi, Yokohama; Nobuyuki Itoh, Kawasaki; Hiroaki Tsuchiya, Yokohama, all of Japan

[73] Assignee: Canon Kabushiki Kaisha, Tokyo, Japan

[21] Appl. No.: 978,464

[22] Filed: Nov. 19, 1992

Related U.S. Application Data

[63] Continuation of Ser. No. 800,769, Dec. 3, 1991, abandoned, which is a continuation of Ser. No. 547,141, Jul. 3, 1990, abandoned.

[30] Foreign Application Priority Data

Jul. 3, 1989 [JP] Japan ..... 1-169885
Jul. 3, 1989 [JP] Japan ..... 1-169887

[51] Int. Cl.[5] ..... G03G 15/06

[52] U.S. Cl. ..... 355/259; 118/651; 118/658; 355/251

[58] Field of Search ..... 355/251, 259; 118/644, 118/651, 657, 658

[56] References Cited

U.S. PATENT DOCUMENTS

| | | | |
|---|---|---|---|
| 4,377,332 | 7/1983 | Tamura | 355/3 |
| 4,380,966 | 4/1983 | Isaka et al. | 118/657 |
| 4,387,664 | 6/1983 | Hosono et al. | 118/658 |
| 4,395,476 | 9/1989 | Kanbe et al. | 430/102 |
| 4,870,461 | 9/1989 | Watanabe et al. | 355/251 |
| 4,982,689 | 1/1991 | Honda et al. | 118/657 X |

FOREIGN PATENT DOCUMENTS

| | | |
|---|---|---|
| 116372 | 7/1982 | Japan . |
| 011974 | 1/1983 | Japan . |
| 131586 | 5/1989 | Japan . |

*Primary Examiner*—Michael L. Gellner
*Assistant Examiner*—P. Stanzione
*Attorney, Agent, or Firm*—Fitzpatrick, Cella, Harper & Scinto

[57] ABSTRACT

A developing apparatus for developing an electrostatic latent image includes a developing device, means for supplying a powdery developer, and a developer carrying member for carrying the powdery developer supplied by the developing device to a developing zone where a latent image bearing member passes. The developer carrying member is blast-treated with irregular particles, and subsequently is blast-treated with regular particles having an average particle size larger than that of the irregular particles, wherein a developer carrying surface of the developer carrying member has a mixed first portion provided by the blast-treatment with the irregular particles only, and a second portion provided by the blast-treatment with the irregular particles and subsequent blast-treatment with the regular particles. A blasting energy applied to the developer carrying member, per unit area thereof, is smaller in the blast-treatment with regular particles than in the blast-treatment with irregular particles. The area of the second portion is 30 t 80%, and the remaining area includes the first portion.

9 Claims, 3 Drawing Sheets

DEVELOPING APPARATUS AND DEVELOPER CARRYING MEMBER USABLE THEREWITH

This application is a continuation of application Ser. No. 07/800,769 filed Dec. 3, 1991 now abandoned which is a continuation of application Ser. No. 07/547,141 filed Jul. 3, 1990 now abandoned.

FIELD OF THE INVENTION AND RELATED ART

The present invention relates to a developing apparatus for developing an electrostatic latent image and a developer carrying member therefor, which are usable with an image forming apparatus such as an electrophotographic apparatus or electrostatic recording apparatus.

A developing apparatus is known wherein a developer is carried on a surface of a developer carrying member in the form of a sleeve (the developer carrying member will hereinafter be called "sleeve") to supply the developer into a developing zone. It is also known that the developer conveying performance is improved by roughening the surface of the sleeve.

A developing apparatus provided with a sleeve having a roughened surface is disclosed, for example, U.S. Pat. Nos. 4,377,332, 4,380,966, 4,870,461 corresponding to a Japanese Laid-Open Patent Application No. 131586/1989, and Japanese Laid-Open Patent Applications Nos. 116372/1982 and 11974/1983. They disclose a sleeve having a developer carrying surface blasted with irregular particles and/or regular particles. Here, the irregular particles means the particles having irregular configuration and having plural sharp peaks, and the "regular particles" means the particles having smooth configuration as in spherical, oval or flat spherical shape substantially without sharp peaks.

Using a surface-roughened sleeve which is blast-treated only with irregular particles having a grain size of #400 (the grain size is in accordance with JIS R6001 (abrading material)), the sleeve being made of stainless steel (SUS 305), as disclosed in U.S. Pat. No. 4,380,966, continuous copying operations were performed with a one component developer (toner particles). Then, the following problem was found.

When the continuous copying operations were performed under the normal temperature and normal humidity ambient conditions, the image density reduced from 1.3 (initial image density) to 1.2 when 5000 sheets were processed. When the continuous copying operations were performed under the low temperature and low humidity conditions, the image density reduced from 1.3 (initial image density) to 1.1 when 5000 sheets were processed.

The cause of the image density reduction is considered as being insufficient triboelectric charge applied to the toner.

Using a sleeve of stainless steel (SUS 305) blast-treated with regular blasting particles having smooth surfaces as of spherical particles having a grain size of #400 in place of the above-described irregular particles, as disclosed in U.S. Pat. No. 4,377,332 or Japanese Laid-Open Patent Application No. 116372/1982 the copying operations were continuously performed. The following problem was found.

When the continuous copying operations were performed under the normal temperature and normal humidity condition, the image density was 1.35, and therefore, was good after 5000 sheets were processed. When the continuous copying operations were performed under the low temperature and low humidity conditions, the image density was 1.3, and therefore, was good when 5000 sheets were processed. However, the toner was found to be non-uniformly applied on the sleeve. In this case, the toner is given sufficient triboelectric charge, but it is considered that the triboelectric charge is further increased under the low temperature and low humidity conditions and that this is the cause of the non-uniformity of the toner application.

A sleeve made of stainless steel (SUS 305) was blast-treated with irregular particles having the grain size #600 and thereafter blast-treated with spherical particles (regular particles) having a grain size #800 which is a smaller average particle size than the irregular particles, as disclosed in Japanese Laid-Open Patent Application No. 11974/1983. The described sleeve was used and the continuous copying operations were performed with the described toner particles. Then, the following problem was found.

When the continuous copying operations were performed under the normal temperature and normal humidity conditions, the image density was 1.3, and therefore, was good when 5000 sheets were processed. When the continuous copying operations were performed under the low temperature and low humidity conditions, the image density was 1.25, and therefore, was good when 5000 sheets were processed. However, the toner application on the sleeve was not uniform.

From the foregoing, it is understood that although the problem of insufficient triboelectric charge of the toner when the sleeve is blast-treated only with the irregular particles has been solved, the control of the triboelectric charge under the low temperature and low humidity condition is not enough.

It is disclosed that the sleeve is blast-treated with a mixture of the irregular particles and regular particles. Since the sleeve has been blast-treated by the mixture, the irregular particles collapse the relatively smooth pits formed by the regular particles, causing some of the pits by the regular particles to have smaller sharp projections therein. The relatively smooth pits or concavities are effective to increase the amount of triboelectric charge of the toner, but the sharp and fine projections decrease the triboelectric charge amount.

SUMMARY OF THE INVENTION

Accordingly, it is a principal object of the present invention to provide a developer carrying member having a suppressed reduction of the triboelectric charge of the developer and having a stabilized conveying force for the developer and a developing apparatus using the developer carrying member.

It is another object of the present invention to provide a developing apparatus by which a uniform developer layer can be formed, and therefore, uniform developed image can be provided, even if the ambient conditions are changed.

It is a further object of the present invention to provide a developing apparatus wherein the change in the image density of the developed image can be suppressed even if the ambient condition is changed.

In one aspect, the present invention provides a developing apparatus for developing an electrostatic latent image, including a developing device, means for supplying a powdery developer, and a developer carrying member for carrying the powdery developer supplied by the developing device to a developing zone where a latent image bearing member passes. The developer carrying member is blast-treated with irregular particles, and subsequently is blast-treated with regular particles having an average particle size larger than that of the irregular particles, wherein a developer carrying surface of the developer carrying member has a mixed first portion provided by the blast-treatment with the irregular particles only, and a second portion provided by the blast-treatment with the irregular particles and subsequent blast-treatment with the regular particles. A blasting energy applied to the developer carrying member, per unit area thereof, is smaller in the blast-treatment with regular particles than in the blast-treatment with irregular particles. The area of the second portion is 30 to 80%, and the remaining area includes the first portion.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
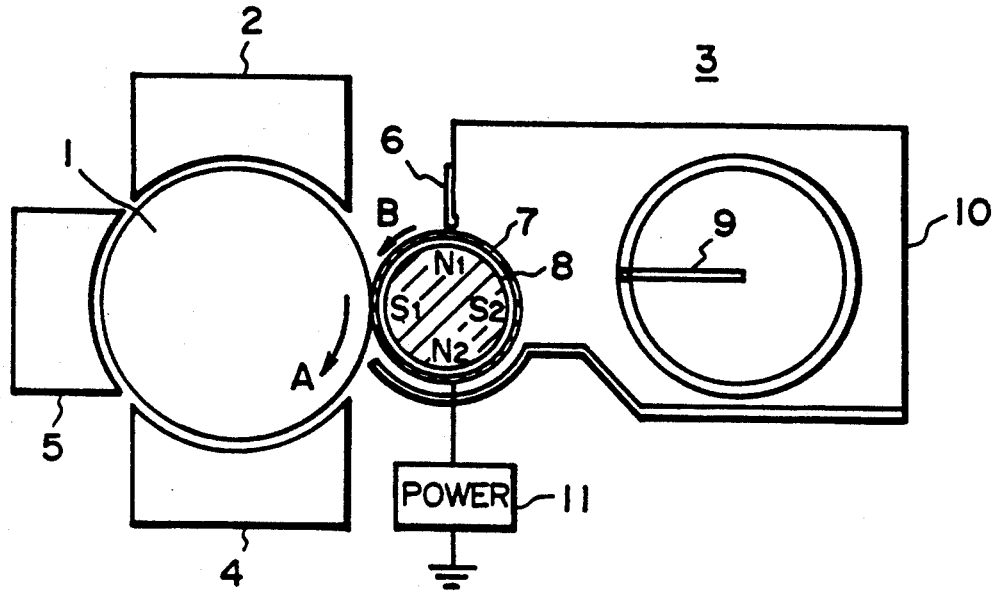
FIG. 1 is a sectional view of a developing apparatus according to an embodiment of the present invention.

Referring to FIG. 1, there is shown a developing apparatus according to an embodiment of the present invention with a schematic view of the other parts of an image forming apparatus used with the developing apparatus. The image forming apparatus comprises a latent image bearing member 1 which is usually in the form of an electrophotographic photosensitive member, which will hereinafter be called "photosensitive drum". The apparatus further comprises a latent image forming station 2, a developing apparatus 3 for visualizing the latent image, according to the embodiment of the present invention, an image transfer and transfer material separating station, which may be of a known type, for transferring a toner image from the photosensitive drum to the transfer material and for separating the transfer material from the photosensitive drum, a cleaning station, which may be of a known type, for removing residual toner from the photosensitive drum. The developer in this embodiment is a magnetic toner containing magnetic particles in the resin materials.

The latent image forming station 2 functions to form an electrostatic latent image on the photosensitive drum 1. The photosensitive drum rotates in the direction indicated by an arrow A to reach the developing device 2. The developing device 2 includes a hopper container 10 for containing the magnetic toner (one component developer), stirring means 9 for supplying the toner from the hopper 10 to the neighborhood of the sleeve and for enhancing the flowability of the toner, a fixed magnet 8 and the non-magnetic sleeve rotatable in a direction B. The sleeve 7 is effective to carry the toner particles into a developing zone where the sleeve 7 is faced to the drum 1, so that the toner is supplied to the drum. The toner particles are triboelectrically charged mainly by the friction with the sleeve 7 to such an extent as is sufficient to develop the latent image.

The thickness of a toner layer formed on the sleeve 7 is regulated by a magnetic blade 6 opposed to a magnetic pole N1 of the magnet 8 through the sleeve 7 (U.S. Pat. No. 4,387,664). In the developing zone where the sleeve 7 and the drum 1 are faced to each other, the toner particles are formed into a brush by a developing magnetic pole S1. By an electric field formed between the latent image on the photosensitive drum 1 and the sleeve 7, the toner particles on the sleeve 7 are transferred to the drum 1 to visualize the latent image thereon. In order to make the toner transfer easier, the sleeve 7 is supplied with a developing bias voltage from a voltage source 11. More particularly, an alternating bias voltage is applied to the sleeve 7 by the voltage source 11. By this, the toner particles released from the sleeve 7 to the drum 1 repeat the deposition onto the drum 1 and the release therefrom, and finally, that is, when the drum surface moves away from the developing zone, the toner particles corresponding to the potential of the latent image are retained on the drum (U.S. Pat. No. 4,395,476). The alternating voltage here includes a vibrating voltage which vibrates only within a positive voltage range or a negative voltage range, as well as the voltage having positive and negative peaks. The present invention is particularly effective when used with the developing apparatus in which the vibratory electric field is formed in the developing zone by the application of an alternating bias voltage to the sleeve 7, but the present invention is applicable to a developing apparatus wherein a DC bias voltage is applied to the sleeve.

The toner image, then, is transferred from the drum to the transfer material at the transfer station 4, and is fixed on the transfer material by an unshown image fixing station. On the other hand, the photosensitive drum after the image transfer is subjected to the cleaning operation at the cleaning station 5, so that the residual toner is removed from the drum 1, by which the drum is prepared for the next image forming operation.

Examples of dimensions and various parameters of the apparatus are as follows: The magnetic pole N1 of the magnet 8 provides 1000 Gauss on the surface of the sleeve 7; S1 pole 1000 Gauss; N2 pole 750 Gauss; S2 pole 550 Gauss. The minimum distance between the sleeve 7 and the drum 1 is 0.25 mm; the distance between the sleeve 7 and the magnetic blade 6 is 0.25 mm. With those dimensions and values, a toner layer formed has a thickness smaller than the clearance between the sleeve 7 and the drum 1. The voltage source 11 applies to the sleeve 7 a voltage having an AC voltage component having a peak-to-peak voltage of 1400 V and a frequency of 1800 Hz and a DC component added thereto having a voltage of +120 V. The photosensitive drum 1 is made of amorphous silicon, on which a latent image is formed with a dark potential (the most dark portion of the image) of +400 V and a light portion potential (background area of the image) of +70 V. The copying speed is 80 sheets/min. when the copy sheet size is A4. The sleeve 7 has a diameter of 32 mm and is made of stainless steel (SUS 305), the surface of which is blast-treated. The sleeve may be made of another material such as aluminum or steel containing titanium.

Figure 2:
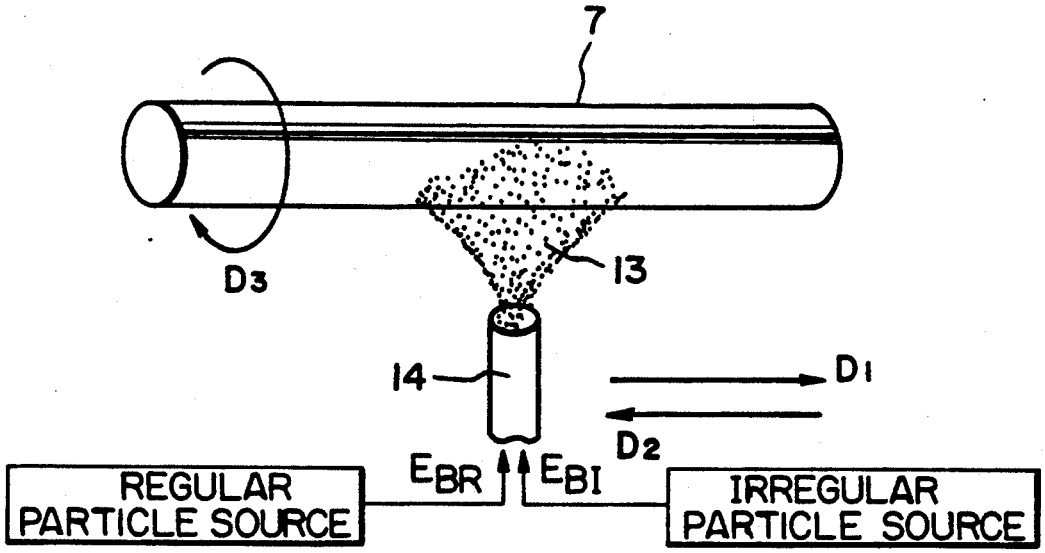
FIG. 2 is a perspective view illustrating a blast-treatment of a developer carrying member with regular particles or irregular particles.

FIG. 2 shows the manner of blast-treating for the sleeve 7. As shown in this Figure, to the sleeve 7, blasting particles, i.e., abrasive particles 13 are blasted through a nozzle 14 with high pressure. The sleeve 7 is rotated in a direction D3, and simultaneously, the nozzle 14 is reciprocated between the opposite ends of the sleeve 7 in parallel with a rotational axis of the sleeve, that is, in directions D1 and D2.

The blasting conditions in this embodiment are as follows. Irregular particles having a grain size #400 (average particles size of 35–45 microns, JIS R6001 (grain size of abrasive material)) made of $Al_2O_3$. The sleeve is rotated at a rotational speed of 12 rpm. The nozzle has a diameter of 7 mm and is away from the sleeve by a distance of 150 mm. The blasting air pressure is 3.5 kg/cm$^2$. The blasting is continued for 30 sec., while the nozzle is reciprocated in parallel with the axis of the sleeve through a distance of 30 cm. Thereafter, the surface of the sleeve is cleaned and dried.

Thereafter, the sleeve is blast-treated with regular particles. The regular particles are glass beads (FGB) having a grain size #100 (average particle size of 150–180 microns). The blasting air pressure is 3.0 kg/cm$^2$. The other conditions are the same as in the blast treatment with the irregular particles. After the blast-treatment, the similar cleaning operation is performed.

Figure 3:
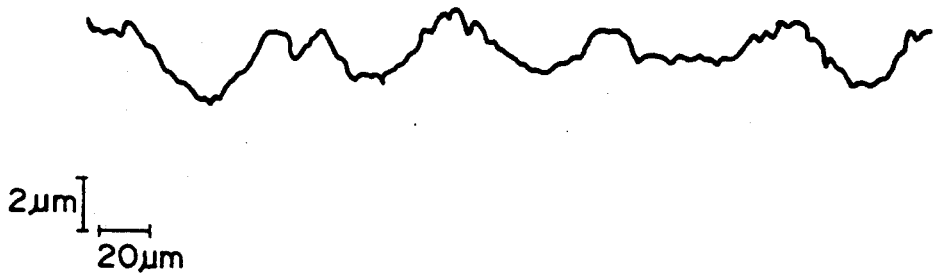
FIG. 3 illustrates a surface roughness of a sleeve according to an embodiment of the present invention.

FIG. 3 shows an enlarged sectional view of the surface of the sleeve according to this embodiment. The surface roughness shown in this Figure was obtained as plots of outputs of a surface roughness measuring device available from Kosaka Kenkyusho, Japan.

Copying operations were performed using the developing apparatus having the developing sleeve described in the foregoing. The change of the image density was sufficiently small in the case of the continuous copying operations and also in the case of intermittent copying operations. More particularly, under the normal temperature and normal humidity condition, the image density was approximately 1.35. Under the low temperature and low humidity condition, the image density was 1.3. The non-uniformity of the toner layer applied on the sleeve surface was not observed.

The surface of the sleeve was checked, and the following constructions were recognized. In approximately 70–80% are of the surface blasted by the finer irregular particles, larger concavities are formed by the regular particles having the average particle size larger than that of the irregular particles. In the concavities, the fine patterns provided by the irregular blasting particles are still retained although they are deformed by the collapse with the regular particles. In the remaining 20–30% area, that is, the area free from the collision with the regular particles, a great number of sharp and fine projections by the irregular blasting particles remain. In the 70–80% area collapsed with the regular particles, the fine projections by the irregular blasting particles are partly collapsed or made dull by the regular particles, that is, the surface is smoother Thus, it has been confirmed that the surface of the sleeve has the fine projections, that the degree of the sharpness of the fine projections are different, and that the different sharpness projections are mixed. In other words, the surface of the sleeve has larger pits and projections on which finer pits and projections are superposed. The larger pits are provided by the collision of the regular particles, wherein the finer projections formed by the irregular particles are provided by collision of the regular particles but the finer projections are still remaining. The pits provided by the regular particles tend to increase the triboelectric charge amount applied to the toner. However, it should be noted that the finer pits and projections provided by the irregular particles still remain although the sharp projections are made dull, so that the over-charge of the toner is suppressed. On the other hand, the regions not collapsed by the regular particles, namely, the areas having the sharp and fine projections provided by the irregular particles, are effective to increase the toner conveying power and to suppress the triboelectric charge of the toner. Accordingly, the toner is triboelectrically charged to proper extent, and in addition, a uniform toner layer is formed on the sleeve. The present invention is, therefore, particularly effective to a developing apparatus of a type wherein the toner layer has a thickness smaller than the minimum clearance between the sleeve and the drum, and wherein the toner jumps from the sleeve to the drum in the developing zone to develop the latent image.

Figure 4:
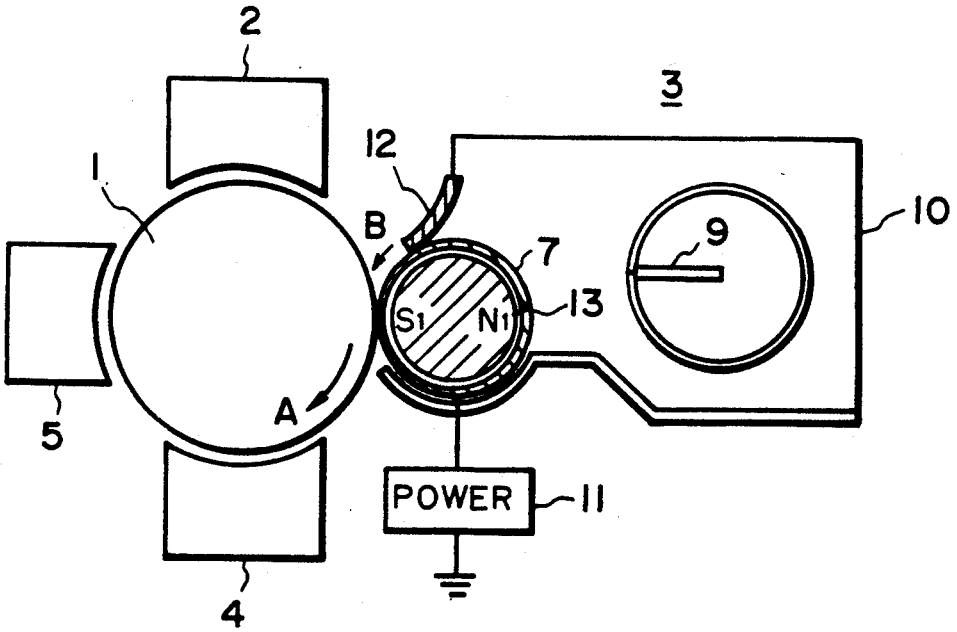
FIG. 4 is a sectional view of a developing apparatus according to another embodiment of the present invention.

Referring to FIG. 4, the description will be made as to a second embodiment. In this Figure, the same reference numerals as in the first embodiment are assigned, and the detailed description thereof are omitted for simplicity.

In this embodiment, no magnetic field is used to regulate the thickness of the toner layer, but a flexible elastic member such as a rubber blade is contacted to the sleeve 7. By the employment of the blade 12 as shown in FIG. 4 to regulate the toner layer, the necessity for the regulating magnetic pole is eliminated. Therefore, the number of magnetic poles can be reduced, which permits use of a small diameter magnet roller. In addition, the cost can be reduced. In FIG. 4, a magnet roller 13 having two magnetic poles is used. The strength of the magnetic pole is 600 Gauss for S1 and 500 Gauss for N1 on the surface of the sleeve. The bias voltage source 11, the clearance between the sleeve 7 and the photosensitive drum 1 and other conditions are the same as in the first embodiment. The toner particles are electrically charged mainly by the friction with the sleeve 7 to such an extent as is sufficient to develop the latent image.

The blade 12 is contacted to the sleeve 7 with a line pressure of 2–10 g/cm along an axis of the sleeve. Examples of usable materials for the blade 12 are urethane rubber (0.8–1 mm thickness), neoprene rubber, or other rubber materials, and a plastic resin sheet For example, there are PET sheets having a thickness of 100 microns, polyamide sheets or polyimide sheets.

In this embodiment, the urethane rubber is used. The sleeve 7 is made of stainless steel (SUS 305), and the surface thereof was blast-treated.

The blast-treatment will be described. After the blast-treatment with the irregular blasting particles as in the first embodiment, the blast-treatment with the regular particles was performed with the glass beads having a grain size #200 (average particle size of 70–90 microns). The air pressure was 2.5 kg/cm$^2$. The other conditions were the same as in the blast-treatment with the irregular particles. The surface of the sleeve was cleaned. When the copying operation was performed using the sleeve, the same good result as in the first embodiment was obtained.

In this embodiment, 70–80% of the area having sharp and fine projections provided by the irregular particles are collapsed by the regular blasting particles so that the sharp projections are made dull.

A third embodiment will be described. In this embodiment, the regular particle blasting treatment is carried out with glass beads having a grain size #30 average particle size of 500–700 microns) which is larger than that of the first embodiment. The other blasting conditions and the structures of the developing apparatus are the same as in the first embodiment. When the continuous copying operations were performed by the apparatus of this embodiment, the image density was 1.3 under the normal temperature and normal humidity condition, and was 1.25 under the low temperature and low humidity condition. The toner layer on the sleeve surface was uniform. When the sleeve surface was observed, it was confirmed that only approximately 30–40% of the area having been subjected to the blasting treatment with the irregular particles was collapsed by the regular particles. This is smaller than in the first embodiment (approximately 70–80%). Thus, when the blasting conditions such as the air pressure in the treatment with the regular particles, is fixed, the percentage of the area subjected to the blast-treatment with the regular particles decreases with increase of the size of the regular particles.

A fourth embodiment will be described. In this embodiment, the particle size of the regular blasting particles used in this embodiment is larger than that of the first embodiment. More particularly, they were glass beads having the grain size #60. The air pressure (blasting pressure) was 3.0 kg/cm$^2$, and the processing time was 20 sec. The other blasting conditions and the structures of the developing apparatus were the same as in the first embodiment. When the continuous copying operations were performed using the sleeve provided according to this embodiment, the good results were provided in the image density and the uniformity of the applied developer layer. In approximately 50% of the area having been subjected to the blast treatment with the irregular particles and having sharp and fine projections, the collapse occurred with the regular particles into a larger pits. In the pits, dull and fine projections were observed. According to this embodiment, it has been confirmed that the roughened surface provided by the blast treatment with the irregular particles and the subsequent blast treatment with the regular particles is effective to maintain the good image density and the good toner application on the sleeve.

Comparison Example 1

Figure 5:
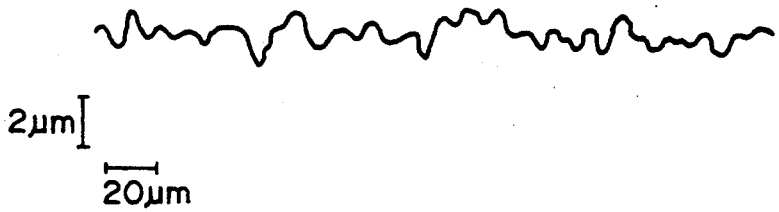
FIG. 5 illustrates the surface roughness of a sleeve employed as a first comparison example.

The sleeve was blast-treated under the same blasting conditions as in the first embodiment except that the regular particles were glass beads having a particle size #600 (average particle size of 30 microns) which was smaller in the particle size than that of the irregular particles. The sleeve was incorporated in the apparatus of FIG. 1, and the continuous copying operations were performed. The image density was 1.35 and therefore, was good under the normal temperature and normal humidity conditions and under the low temperature and low humidity conditions. However, the non-uniformity in the toner layer on the sleeve was observed under the low temperature and low humidity conditions. The surface roughness of the sleeve is shown in FIG. 5.

From the comparison between the embodiments of the present invention and the first comparison example, it is understood that in order to maintain the image density and to provide uniform toner layer, the average particle size of the regular blasting particles is preferably larger than that of the irregular blasting particles. If the size of the regular particles is smaller than that of the irregular particles, the area treated by the regular blast particles is too large, with the result that the surface is similar to the surface treated only by the regular blasting particles, and therefore, the non-uniform toner application is produced. Therefore, it is preferable that the size of the regular particles is larger than that of the irregular particles. By doing so, the pits which are relatively large and relatively smooth, and therefore, which are effective to triboelectrically charge the toner efficiently can be formed, while retaining proper areas having sharp and fine projections by the irregular blasting. If, on the other hand, the size of the irregular particles is too large, the percentage of the area subjected to the blasting treatment with the regular particles is reduced with the result of insufficient triboelectric charging of the toner, with the result of failure of maintaining the good image density. In consideration of the foregoing, the average particle size of the regular blasting particles is preferably larger than the average particle size of the irregular blasting particles and is smaller than 20 times the size of the irregular blasting particles. Further preferably, the average particle size of the regular particles is larger than 1.5 times the average particle size of the irregular particles and smaller than 10 times the size of the irregular blasting particles.

The description will be made as to a second and third Comparison Examples. In these examples, the sleeve was treated only with the regular blasting particles or only with the irregular blasting particles, and the sleeve was incorporated in the apparatus of FIG. 1.

Figure 6:
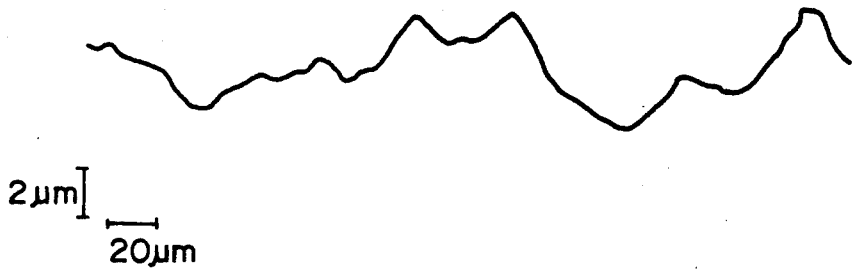
FIG. 6 illustrates a surface roughness of a sleeve employed as a second comparison example.

The sleeve was not blast-treated with the irregular particles, but is treated only with the regular blasting particles. More particularly, it was treated with spherical glass beads having the grain size #100 or #300 with the air pressure of 4.0 kg/cm$^2$ for 60 sec. The image density was good, more particularly, it was 1.35 under the normal temperature and normal humidity conditions, and was 1.3 under the low temperature and low humidity conditions. However, the toner coating on the sleeve was not uniform under the low temperature and low humidity conditions. The surface roughness of the sleeve in this example when the size of the spherical glass beads was #100 is shown in FIG. 6.

Third Comparison Example

Figure 7:
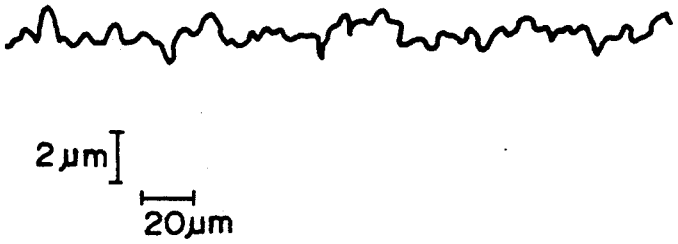
FIG. 7 illustrates a surface roughness of a sleeve employed as a third comparison example.

The sleeve was treated in the same manner as in the first embodiment, but it was treated only with the irregular blasting particles. The image density at the initial stage was not higher than 1.2 under the normal temperature and normal humidity conditions and under the low temperature and low humidity conditions. The toner layer was uniform even under the low temperature and low humidition conditions. The surface roughness of the sleeve produced by the third Comparison Example is shown in FIG. 7.

The amount of the triboelectric charge of the toner on the sleeve surface was measured for the sleeve produced by the second Comparison Example and for the sleeve by the third Example, and it was confirmed that it was high in the second Comparison Example, but it was low in the third Comparison Example.

From the above, it is understood that the surface of the sleeve preferably has a part having sharp and fine projections and also a part having dull and fine projections in order to maintain both of the image density and the uniformity of the toner layer formation.

On the surface of the sleeve where the sharp and fine projections provided by the irregular particles are made dull by the regular particles in the entire area or on the surface having been subjected to the blast treatment only with the regular particles, the contact between the toner particles and the sleeve surface is active, so that the triboelectric charge of the toner is high. However, the increase of the triboelectric charge is not suppressed. It is considered that some toner particles are extremely highly charged triboelectrically and are deposited on the surface of the sleeve by the electrostatic mirror force. If this occurs, such toner particles are not easily released from the sleeve surface during the image forming operation, and this is a cause of the nonuniformity of the toner layer. The sleeve surface having the sharp and fine projections on its entirety can mechanically capture the toner particles, and therefore, the motion of the toner particles are obstructed with the result of less opportunity of the toner particles contacting the sleeve surface. This is considered as being the reason why the sufficient triboelectric charge is not applied to the toner particles. From the above, the percentage of the area of the pits formed by the collapse with the regular particles on the sleeve surface, that is, the area effected by the regular particles is preferably larger than 10% and smaller than 90%, further preferably larger than 30% and smaller than 80%. The rest of the area is a roughened surface having sharp and fine projections provided by the irregular particles without being effected by the regular particles.

The description will be made as to a fifth embodiment of the present invention, wherein the treatment with the irregular blasting particles is performed under the same conditions as in the first embodiment. Thereafter, the sleeve is subjected to the blast treatment with the regular particles having the grain size #100 as in the first embodiment. The air pressure (blasting pressure) was 4.0 kg/cm$^2$ higher than in the first embodiment, and the processing period was 60 sec. longer than in the first embodiment. The sleeve produced according to this embodiment was incorporated in the apparatus of FIG. 1. The image density was good, but the toner application was slightly nonuniform under the low temperature and low humidity conditions. In has been confirmed that the number of sharp and fine projections provided by the irregular particle treatment was extremely small, due to the regular particle treatment. The reason for this is considered as follows. The energy applied onto the sleeve surface per unit area, that is, the energy of collision is larger in the blast treatment with the regular blasting particles than in the blast treatment with the irregular blasting particles. Accordingly, the further preferable blasting condition is that the energy applied onto the sleeve per unit area thereof dependent upon (1) a distance between the nozzle and the sleeve, (2) air pressure (blasting or ejection pressure), (3) processing period and (4) grain size of the particles, is smaller in the blast treatment with the regular particles effected afterward than in the blasting treatment with the irregular particles before that. According to an aspect of the present invention, the average particle size of the regular particles is larger than that of the irregular particles, so that in the case of the blast treatment with the regular particles, the distance between the nozzle and the sleeve is made larger than in the case of the blast treatment with the irregular particles, and/or, the air pressure is made smaller, and/or, the processing period is made shorter, each of which is preferable.

Irregular particles are silicon carbide particles, alumina particles, iron trioxide particles or titanium dioxide particles; and the regular particles are glass beads, steel particles, ferrite particles or flat ferrite particles. However, they are not limited to these materials.

The developer carrying member is not limited to the cylindrical sleeve, but it may be columnar or in the form of a belt. It also may be a magnet roller.

In the foregoing embodiments, the thickness of the developer layer carried into the developing zone is a thickness smaller than the clearance between the sleeve and the drum, but the present invention is applicable to a developing apparatus wherein the thickness of the developer layer is the same as or larger than the clearance between the sleeve and the drum.

The present invention is suitable to the toner having the average particle size of 3–15 microns (volume average particle size which can be measured by a counter available from Coulter). However, the present invention is not limited to this.

In the foregoing embodiments, a one component magnetic developer is used, but the present invention is applicable to a one component non-magnetic developer. In this case, the developing apparatus shown in FIG. 4 but without the magnet 13 is preferable.

While the invention has been described with reference to the structure disclosed herein, it is not confined to the details set forth and this application is intended to cover such modifications or changes as may come within the purposes of the improvements or the scope of the following claims.

We claim:

1. A developing apparatus for developing an electrostatic latent image, comprising:

means for supplying a powdery developer;

a developer carrying member for carrying the powdery developer supplied by said supplying means to a developing zone where a latent image bearing member passes;

wherein said developer carrying member is blast-treated with irregular particles, and subsequently blast-treated with regular particles having an average particle size larger than that of the irregular particles, wherein a developer carrying surface of said developer carrying member has a mixed first portion provided by the blast-treatment with the irregular particles only and a second portion provided by the blast-treatment with the irregular particles and subsequent blast-treatment with the regular particles, wherein a blasting energy applied to the developer carrying member, per unit area thereof, is smaller in the blast-treatment with regular particles than in the blast-treatment with irregular particles, wherein the area of the second portion is 30–80%, and the remaining area comprises the first portion, wherein the developer comprises a one component developer, and wherein said developer carrying member is arranged to triboelectrically charge the developer to develop the latent image.

2. An apparatus according to claim 1, further comprising a voltage source for applying an alternating voltage to said developer carrying member to form a vibratory electric field in the developing zone.

3. An apparatus according to claims 1 or 2, further comprising an elastic regulating member in contact with said developer carrying member to regulate a thickness of a layer of the developer carried to the developing zone to a thickness smaller than a clearance between the latent image bearing member and said developer carrying member.

4. An apparatus according to claim 1 or 2, further comprising a stationary magnet disposed in said developer carrying member, wherein said developer carrying member comprises non-magnetic material and carries the developer containing magnetic particles, and a magnetic regulating member disposed opposed to said developer carrying member with a small clearance, said magnetic regulating member being opposed to said developer carrying member with a small clearance, said magnetic regulating member being opposed to a magnetic pole of the magnet through said developer carrying member and being effective to regulate a layer of the developer carried to the developing zone to a thickness smaller than a clearance between the latent image bearing member and said developer carrying member.

5. A developing apparatus for developing an electrostatic latent image, comprising:

means for supplying a powdery developer;

a developer carrying member for carrying the powdery developer supplied by said supplying means to a developing zone where a latent image bearing member passes;

wherein said developer carrying member is blast-treated with irregular particles and subsequently blast-treated with regular particles having an average particle size larger than that of the irregular particles, wherein a developer carrying surface of said developer carrying member has a mixed first portion which has sharp and fine projections provided by the blast-treatment with the irregular particles only and a second portion having less sharp and fine projections provided by the blast-treatment with the irregular particles and subsequent blast-treatment with the regular particles, wherein a blasting energy applied to the developer carrying member, per unit area thereof, is smaller in the blast-treatment with regular particles than in the blast-treatment with irregular particles, wherein the area of the second portion is 30–80%, and the remaining area comprises the first portion, wherein the developer comprises a one component developer, and wherein said developer carrying member is arranged to triboelectrically charge the developer to develop the latent image.

6. An apparatus according to claim 5, further comprising a voltage source for applying an alternating voltage to said developer carrying member to form a vibratory electric field in the developing zone.

7. An apparatus according to claim 5 or 6, further comprising an elastic regulating member in contact with said developer carrying member to regulate a thickness of a layer of the developer carried to the developing zone to a thickness smaller than a clearance between the latent image bearing member and said developer carrying member.

8. An apparatus according to claim 5 or 6, further comprising a stationary magnet disposed in said developer carrying member, wherein said developer carrying member comprises non-magnetic material and carries the developer containing magnetic particles, and a magnetic regulating member disposed opposed to said developer carrying member with a small clearance, said magnetic regulating member being opposed to a magnetic pole of the magnet through said developer carrying member and being effective to regulate a layer of the developer carried to the developing zone to a thickness smaller than a clearance between the latent image bearing member and said developer carrying member.

9. A developer carrying member for carrying a powdery one-component developer to a developing zone where an electrostatic latent image is developed, and for triboelectrically charging the developer to develop the latent image, the improvement comprising:

mixed first and second portions on a surface of said developer carrying member which is blast-treated with irregular particles and subsequently blast-treated with regular particles having an average particle size larger than that of the irregular particles, wherein the first portion has sharp and fine projections provided by blast-treatment with the irregular particles only, and the second portion has less sharp and fine projections provided by blast-treatment with the irregular particles and subsequent blast-treatment with the regular particles, wherein a blasting energy applied to the developer carrying member, per unit area thereof, is smaller in the blast-treatment with regular particles than in the blast-treatment with irregular particles, wherein the area of the second portion is 30–80%, and the remaining area comprises the first portion.

* * * * *

UNITED STATES PATENT AND TRADEMARK OFFICE

CERTIFICATE OF CORRECTION

PATENT NO. : 5,227,849

DATED : July 13, 1993

INVENTOR(S) : KATSUMI ET AL.

It is certified that error appears in the above-identified patent and that said Letters Patent is hereby corrected as shown below:

At [57] Abstract

Line 20, change "30 t 80%, to --30 to 80%,--.

Column 2

Line 37, change "It is" to --In U.S. Patent 4,870,641, it is--.

Column 5

Line 51, change "are" to --of the area--.
Line 58, change "area," to --of the area--.
Line 64, change "smoother" to --smoother.--.

Column 6

Line 30, change "description" to --descriptions--.
Line 54, change "sheet" to --sheet.--.

Column 7

Line 9, change "#30 aver-" to --#30 (aver- --.
Line 46, delete "a".

UNITED STATES PATENT AND TRADEMARK OFFICE

CERTIFICATE OF CORRECTION

PATENT NO. : 5,227,849 Page 2 of 2

DATED : July 13, 1993

INVENTOR(S) : KATSUMI ET AL.

It is certified that error appears in the above-identified patent and that said Letters Patent is hereby corrected as shown below:

Column 8

Line 33, delete "a".
Line 37, Insert subheading --Second Comparison Example--.
Line 60, change "humidition" to --humidity--.

Signed and Sealed this

Twenty-first Day of June, 1994

*Attest:*

Bruce Lehman

BRUCE LEHMAN

*Attesting Officer*

*Commissioner of Patents and Trademarks*